United States Patent [19]

Alazet

[11] Patent Number: 4,575,902

[45] Date of Patent: Mar. 18, 1986

[54] DEPILATING APPLIANCE

[75] Inventor: Jean Alazet, Perpignan, France

[73] Assignee: Francis Cardus, Paris, France; a part interest

[21] Appl. No.: 684,360

[22] Filed: Dec. 12, 1984

[30] Foreign Application Priority Data

Dec. 22, 1983 [FR] France ..... 83 20539

[51] Int. Cl.[4] ..... A45D 26/00

[52] U.S. Cl. ..... 19/2; 69/20; 69/26

[58] Field of Search ..... 19/2; 69/20, 26

[56] References Cited

U.S. PATENT DOCUMENTS 2,788,651 4/1957 Qwarnstrom ..... 69/26 X 3,468,141 9/1969 Soleanicov et al. ..... 69/20

3,608,153 9/1971 Berrett ..... 19/2

3,911,530 10/1975 Kalfsbeek et al. ..... 69/26 X

*Primary Examiner*—Louis K. Rimrodt

*Attorney, Agent, or Firm*—Young & Thompson

[57] ABSTRACT

A depilating appliance comprises a series of adjacent, closely-spaced hair-plucking disks driven by an electric motor housed within a casing which is designed to be held in one hand. The disks form a roller unit which is rotatably mounted behind a slot, grid or the like provided in one end of the casing. Superfluous hairs to be removed are engaged between the disks in a combing action, periodically gripped by deformation of the disks, then pulled and plucked-out as a result of rotational displacement of the disks.

10 Claims, 10 Drawing Figures

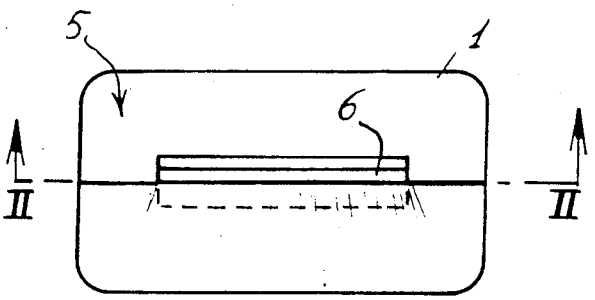
Fig: 1
Fig: 2
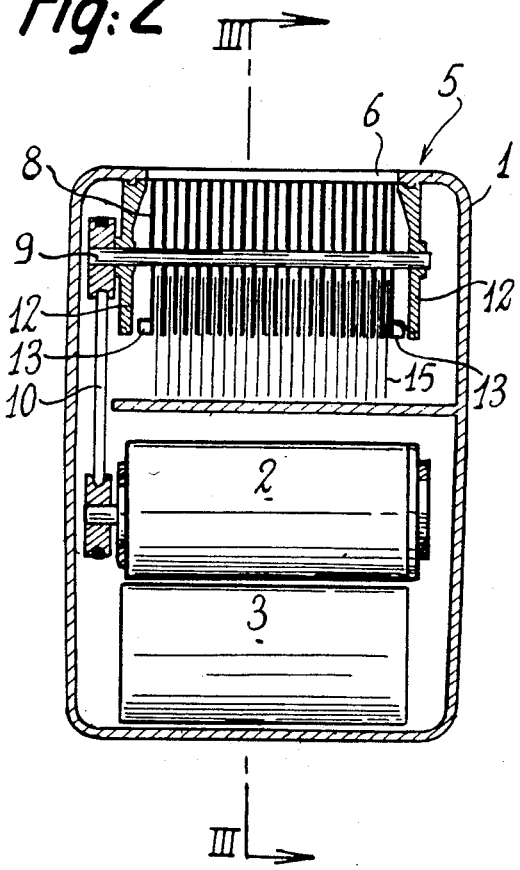
Fig: 3
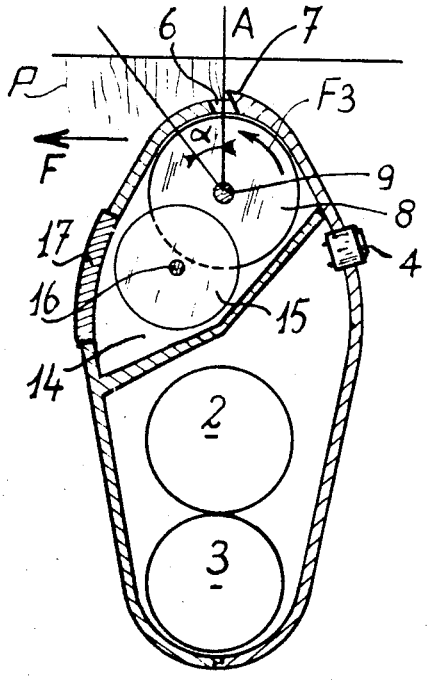

DEPILATING APPLIANCE

BACKGROUND OF THE INVENTION

1. Field of the Invention

This invention relates to a small depilating appliance which can be held in one hand and is intended to permit removal of superfluous hairs.

2. Description of the Prior Art

Small appliances designed for the same purpose are already in existence. Thus French patent Application No. 2,307,491 describes an appliance comprising two pairs of rollers which rotate in opposite directions for plucking-out hairs as they engage between the rollers. This appliance, however, is of limited efficiency by reason of the basic nature of the elements employed for plucking hairs. Another cause of low efficiency of an appliance of this type lies in the fact that the point at which the hairs are effectively gripped between the two rollers or in other words the point of contact between these latter is necessarily set back at a substantial distance with respect to the corresponding end of the casing of the appliance.

French patent Application No. 2,334,320 describes another depilating appliance in which provision is made for a helical spring which rotates about its own axis and the turns of which are alternately expanded and then closed against each other in order to permit engagement of the hairs between the turns of the spring when they are in the expanded state, the hairs being then gripped between the turns as they close in order to be plucked-out by reason of the rotational displacement of the spring about its own axis.

However, the ends of the hairs to be plucked cannot readily engage between the turns of the rotating spring by reason of the helical shape of these latter. For the same reason, the hairs are displaced by the turns in the transverse direction as they rotate, thus having the effect of preventing the hairs from penetrating within the spring to a suitable extent. However, the hairs which have nevertheless succeeded in engaging between the turns are then gripped at only one point, namely at the point of contact between the two turns located on each side. There is therefore a substantial risk of slippage when the spring continues to rotate, in which case the corresponding hairs are not plucked-out by the spring. Finally, no means are provided for subsequent removal of the hairs which have engaged between the turns of the plucking-spring. Such a removal would in any case be very difficult to perform.

SUMMARY OF THE INVENTION

For the reasons stated in the foregoing, the appliance in accordance with the invention is so designed as to circumvent the drawbacks of currently available appliances in order to achieve really efficient operation and thus to permit easy and rapid plucking of hairs to be removed.

To this end, the distinctive feature of said appliance lies in the fact that the elements for plucking hairs to be removed comprise a series of disks placed in adjacent relation with a small clearance between them and forming a roller unit rotatably mounted behind a slot, a grid or the like provided in one end of the casing, and that provision is made for means whereby hairs which have engaged between the disks are periodically gripped and clamped against said disks in such a manner as to ensure that said hairs are thus pulled by the disks and plucked-out as a result of rotational displacement of said disks.

In a particular embodiment of the appliance in accordance with the invention, the rotary disks are flexible or resilient and the means for periodically gripping the hairs to be plucked-out comprise means for closing-up and applying all the rotary disks against each other in proximity to that portion of the disks which is located behind the slot or grid of the casing, the periodic hair-gripping action being produced by deformation of said disks.

In another embodiment, the means for periodically gripping the hairs to be plucked comprise a series of parallel hair-gripping blades engaged between the rotary disks and carried by a support which is mounted so as to be capable of displacement in a direction parallel to the disk shaft, means being provided for periodically displacing said support in such a manner as to apply the hair-gripping blades against the rotary disks in order to imprison the hairs to be plucked.

Thus, in both of the embodiments outlined in the foregoing, the ends of the hairs to be plucked engage very readily between the rotary disks since these latter are parallel to each other and perpendicular to their axis of rotation. Furthermore, the appliance in accordance with the invention achieves optimum efficiency since the hairs engaged between the rotary disks are not gripped at only one point but are gripped over the entire distance corresponding to the depth of engagement of the hairs between the disks.

BRIEF DESCRIPTION OF THE DRAWINGS

Other features of the invention will be more apparent upon consideration of the following description and accompanying drawings, wherein:

FIG. 1 illustrates a first embodiment of the appliance in accordance with the invention and more specifically an end view showing the point at which an inlet slot is provided for the engagement of the hairs to be plucked;

FIG. 2 is a sectional view taken along line II—II of FIG. 1;

FIG. 3 is a sectional view taken along line III—III of FIG. 2;

DESCRIPTION OF THE PREFERRED EMBODIMENTS

Figure 4:
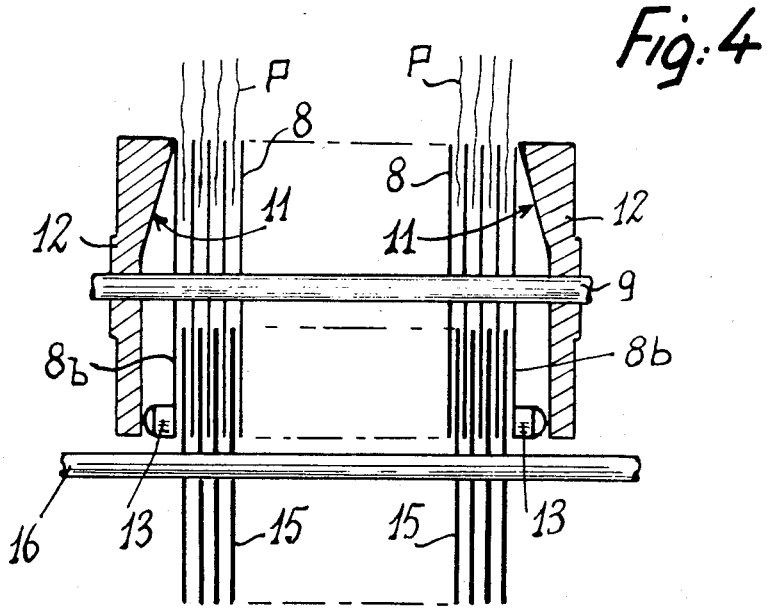
FIGS. 4 and 5 are sectional views taken along the same plane of cross-section as FIG. 2 but drawn to a different scale, in which these two views illustrate respectively the engagement of hairs to be plucked between the rotary disks and the gripping of hairs by said disks.

The appliance shown in FIGS. 1 to 5 comprises a small casing 1 which can be held in one hand and is constituted by two half-shells assembled together.

Within said casing is mounted a small electric motor 2 supplied with current by a dry cell 3 or rechargeable battery. Operation of the motor can be initiated by means of a push-button 4 which projects from one side of the casing.

A slot 6 is formed at one end 5 of the casing for the purpose of receiving the hairs to be plucked. The walls of said slot are preferably inclined as shown in FIG. 3 in order to facilitate penetration of the hairs P within said slot when the appliance is displaced over the skin in the direction of the arrow F in which the appliance is intended to be moved. The outer edge of the slot 6 which is located on the opposite side has a projecting nose 7, the intended function of which is to produce a "raking-in" action in order to cause the hairs to penetrate into the slot 6.

Behind said slot is placed a rotating roller unit constituted by a series of disks 8 of resilient metal carried by a shaft 9. Said shaft is coupled with the output shaft of the motor 2 by means of a driving-belt 10 passed over corresponding pulleys. A noteworthy feature is that the end 5 of the casing has a contour corresponding to a portion of cylinder, the axis of which coincides with that of the shaft 9. Furthermore, the arrangement is such that, at their periphery, the disks 8 are located in the immediate vicinity of the internal face of the end portion 5 of the casing and therefore in very close proximity to the corresponding opening of the slot 6.

In their normal position illustrated in FIGS. 2 and 4, the disks 8 are located in closely spaced relation so that the hairs P which enter through the slot 6 can engage between the disks as shown in FIG. 4. However, suitable means are provided for periodically clamping the rotary disks 8 against each other over a part of their surface in order to grip the hairs which have engaged between the disks.

In the example illustrated in the drawings, these disk-clamping means comprise ramps 11 carried by two stationary end-plates 12 placed at each end of the roller unit formed by the rotary disks 8. A boss 13 which is adapted to cooperate with said ramps is provided on the end disks 8*b* of said roller unit and is placed at a predetermined point of the periphery of said disks opposite to the end-plates 12.

Thus, at each revolution of the roller unit formed by the disks 8, the bosses 13 come into contact with the ramps 11 which are located in proximity to the slot 6. Under these conditions, said bosses are thrust inwards in the direction of the arrows F1 and F2, with the result that the corresponding portion of all the disks undergoes deformation as shown in FIG. 5.

Figure 5:
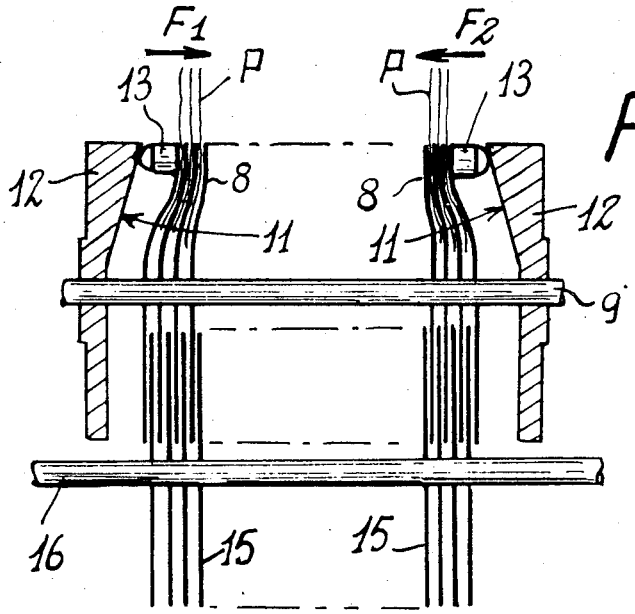

This results in tight clamping of the disks against their corresponding portions and consequently in very firm gripping of the hairs P which have previously engaged between the disks (as shown in FIG. 5). Under these conditions, the hairs are pulled as a result of rotation of the disks 8 and are thus plucked-out.

Preferably, the ramps 11 extend over an angular sector $\alpha$, this sector being located immediately behind the radius OA which passes through the slot 6 if consideration is given to the direction of rotation F3 of the disks 8. The value of this angular sector can be of the order of 30°. However, this value can be variable.

Beyond this angular sector, the disks 8 are continuously maintained in spaced relation. Under these conditions, the hairs removed by the rotary disks 8 are readily freed from the disks and fall into the bottom of the compartment 14 located beneath these latter. It should be pointed out, however, that the disks 8 are clamped opposite to the slot 6 as described above only once per revolution. In fact, over the remainder of their surface, these disks remain in spaced relation to each other in their normal position shown in FIG. 4, which is in any case essential in order to ensure that the hairs P can engage between said disks.

It should be noted in this connection that the mode of operation is quite different from that of the hair-plucking spring proposed in French patent Application No. 2,334,320 cited earlier. In fact, when this spring is compressed, the turns of the spring are applied against each other over their entire surface. The hairs which have been removed can therefore be released only after expansion of the spring has taken place. However, this involves a certain time-delay and consequently limits the speed of operation.

As already mentioned, engagement of hairs between the disks takes place very easily by reason of the fact that these latter are parallel to each other and perpendicular to their axis of rotation or shaft 9 on which they are mounted. Furthermore, at the time of subsequent clamping of the disks 8, the hairs are gripped over the entire length of the portion which is engaged within the disks. Under these conditions, there is no potential danger of slippage of hairs with respect to the disks and optimum efficiency of plucking of hairs to be removed is consequently achieved.

Moreover, in order to ensure that there is absolutely no risk of slippage, the disks can be subjected to a surface roughening treatment. Striae, depressions or elevations of any other type may also be formed on the disk surfaces.

Taking into account the fact that a small space always remains between the disks 8 except for the front portion located next to the slot 6 and that said disks are perpendicular to their axes of rotation, it is possible to provide cleaning elements which engage between the disks for the purpose of removing hairs which have been plucked-out. Said cleaning elements can consist of bristles of a brush which can be either stationary or movable. However, said cleaning elements can also consist of a series of cleaning disks carried by a shaft 16. These disks can be stationary or, if so required, rotatably mounted so as to be capable of rotating in the direction opposite to the hair-plucking disks 8. The function of said cleaning disks is thus to remove the plucked hairs which still remain engaged between the plucking disks 8. These hairs are therefore caused to fall into the compartment 14 from which they can be removed after detachment of a small cover 17 provided for this purpose on the casing of the appliance. It is worthy of note that the possibility of cleaning of the hair-plucking disks 8 by means of elements which engage between these latter offers an advantage which constitutes a characteristic feature of the appliance in accordance with the invention. The cleaning operation thus provided would in fact be radically impossible in the case of the plucking spring proposed in the apparatus described in French patent Application No. 2,334,320 cited earlier.

However, the main advantage of the appliance under consideration lies in its particularly high efficiency. Under these conditions it is only necessary to move said appliance over the surface of the skin in order to produce systematic plucking-out of all the hairs to be removed. This operation is made even easier by the fact that the appliance can very conveniently be held in one hand since it is similar in shape to a small electric shaver.

It will be readily understood that the appliance in accordance with the invention is not limited to the single example of construction described in the foregoing. It would accordingly be possible to provide two bosses 13 instead of only one boss on the end hair-plucking disks 8*a* and 8*b* in order to bring all the disks together twice per revolution. Furthermore, the means employed for periodically closing-up all the hair-plucking disks could be different from those contemplated in the example which is illustrated in the drawings. Said means could thus consist of electromagnets which are placed on each side of the disks and are capable of clamping them together. In addition, in order to reduce the distance between the hair-gripping point of the disks and the roots of the hairs to be plucked, the corresponding end of the casing could be constituted by a curved grid, the hairs to be plucked being permitted to pass between the interstices of the grid. In another alternative form of construction, the disks could be slidably mounted on their rotary driving-shaft in order that they may thus be moved into contact with each other and then again separated.

FIGS. 6 to 9 illustrate a second embodiment of the depilating appliance in accordance with the invention. This embodiment differs from the preceding in the fact that the gripping action on the hairs to be removed is not produced by localized deformation of the rotary disks and clamping of these latter against each other but by additional gripping means which are capable of applying the hairs against the rotary disks.

As in the preceding embodiment, this appliance comprises a small casing 1*a* which can be held in one hand and one end of which has an opening provided with a grid 6*a* for engagement of the hairs to be plucked. Behind said grid, provision is made as before for a rotary shaft 9*a* which also carries end-plates 18*a* and 18*b*, the ends of said shaft being engaged in bearings 19 provided in the corresponding walls 20 of the casing. One of the end-plates, namely the end-plate 18*a* in the example shown in the drawings, is provided with a peripheral set of teeth disposed in meshing engagement with pinions and is thus coupled with the driving motor which is housed within the casing 1*a*.

Figure 8:
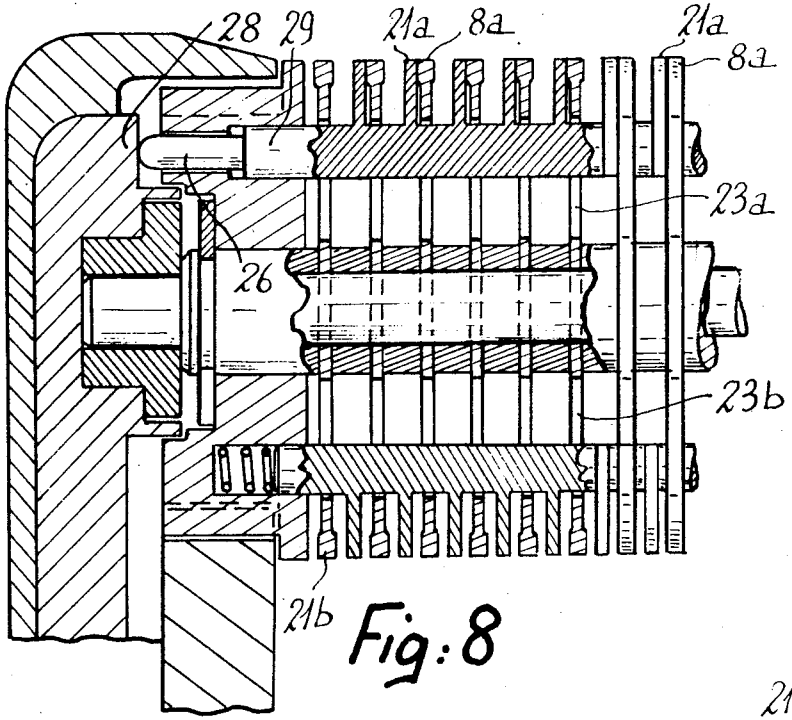

The hair-gripping means provided in this embodiment consist of two combs each formed by a series of blades 21*a* or 21*b* engaged between the rotary disks 8*a* and carried by a shaft 22*a* or 22*b*. These two combs are virtually integrated with the rotating roller unit formed by the disks 8*a* and are accordingly intended to rotate with said unit. Said two hair-gripping combs are disposed in diametrically opposite positions with respect to the shaft 9*a* of the rotating roller unit. The comb-shafts 22*a*, 22*b* are parallel to said shaft 9*a* whilst the comb-blades 21*a* or 21*b* are parallel to the rotary disks 8*a*. As shown in FIG. 8, the blades 21*a* or 21*b* of each comb occupy only a small portion of the surface of the disks 8*a* opposite to the periphery of these latter. The shaft 22*a* or 22*b* of each comb aforesaid is engaged through the openings 23*a* or 23*b* formed in the rotary disks 8*a*. However, these openings are sufficiently large to allow the disks 21*a* or 21*b* to pass in order to permit positioning of each hair-gripping comb within the rotating roller unit by engaging said blades 21*a* or 21*b* between the disks 8*a*. However, as is apparent from FIG. 8, the openings 23*a* or 23*b* thus provided are displaced with respect to the final position occupied by the blades 21*a* or 21*b* of the two hair-gripping combs. Positioning of the combs must therefore be performed by subjecting them to a radial displacement after they have been placed within the openings 23*a* or 23*b*.

The ends of each comb shaft are slidably mounted within bores formed within the end-plates 18*a* and 18*b*. More specifically, one of said shaft-ends 24 is engaged within a blind-end bore containing a spring 25 which tends to maintain each comb in the normal position in which the comb blades 21*a* or 21*b* are located at a point mid-way between the disks 8*a* of the rotating roller unit as shown in FIG. 6, with the result that the hairs to be plucked are permitted to engage between the disks and the comb blades.

Figure 9:
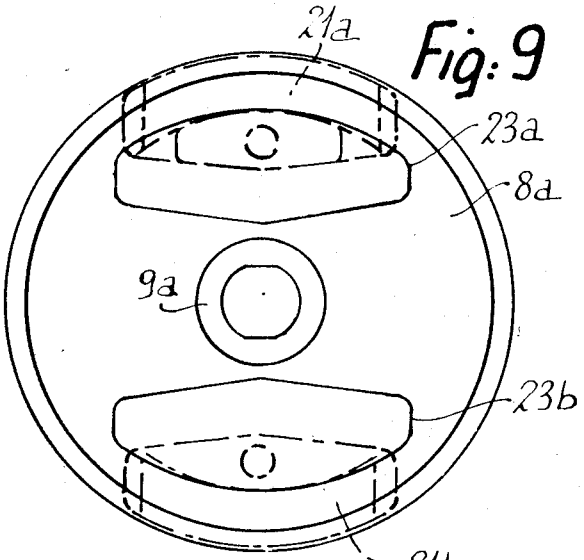
FIG. 9 is a view in end elevation drawn to a different scale and showing one of the rotary disks provided in this appliance.
Figure 10:
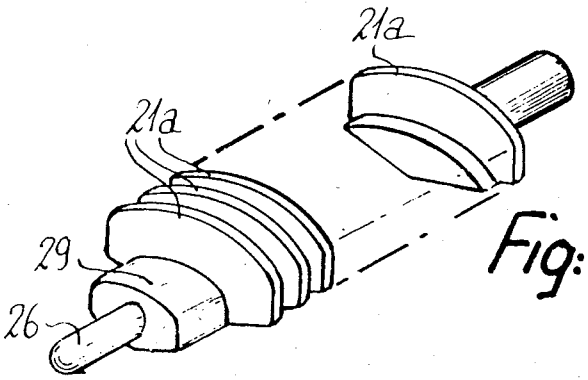
FIG. 10 is a view in perspective which is also drawn to a different scale and shows one of the hairgripping combs which is provided in said appliance and consists of a series of gripping blades carried by a displaceable support.

In regard to the opposite end 26 of the shaft of each hair-gripping comb, said shaft-end is slidably mounted within a bore of the corresponding end-plate. Said bore opens to the exterior and the shaft-end is applied against a cam 27*a* or 27*b* carried by the respective wall of the casing. The profile of said cam is such that this latter is capable of thrusting-back the shaft 22*a* or 22*b* of the corresponding hair-gripping comb when this latter is located immediately beyond the casing slot at the location of the grid 6*a* through which the hairs to be plucked are intended to pass. Each cam aforesaid is therefore provided with a boss 28 in the angular sector concerned, that is to say a sector corresponding to the sector $\alpha$ shown in FIG. 3 in the case of the preceding embodiment. In consequence, when each hair-gripping comb is located within the angular sector concerned during rotation of the roller unit formed by the disks 8*a*, said hair-gripping comb is thrust-back in the axial direction to a position in which the blades of said comb are powerfully applied against the oppositely-facing disks 8*a*, as shown in FIG. 9 in the case of the blades 21*a* of the corresponding comb. FIG. 9 corresponds to a cross-section along a plane which passes through the center of the angular sector concerned and which is therefore angularly displaced with respect to the section plane of FIG. 7.

Figure 6:
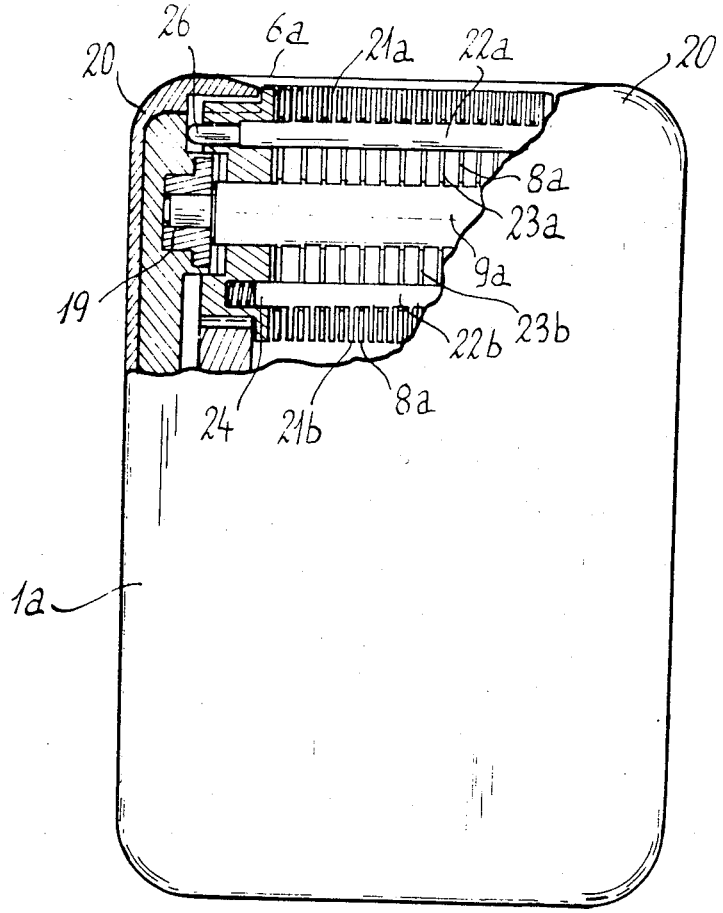
FIG. 6 is a view in elevation with a portion broken away and showing another embodiment of the appliance in accordance with the invention.
Figure 7:
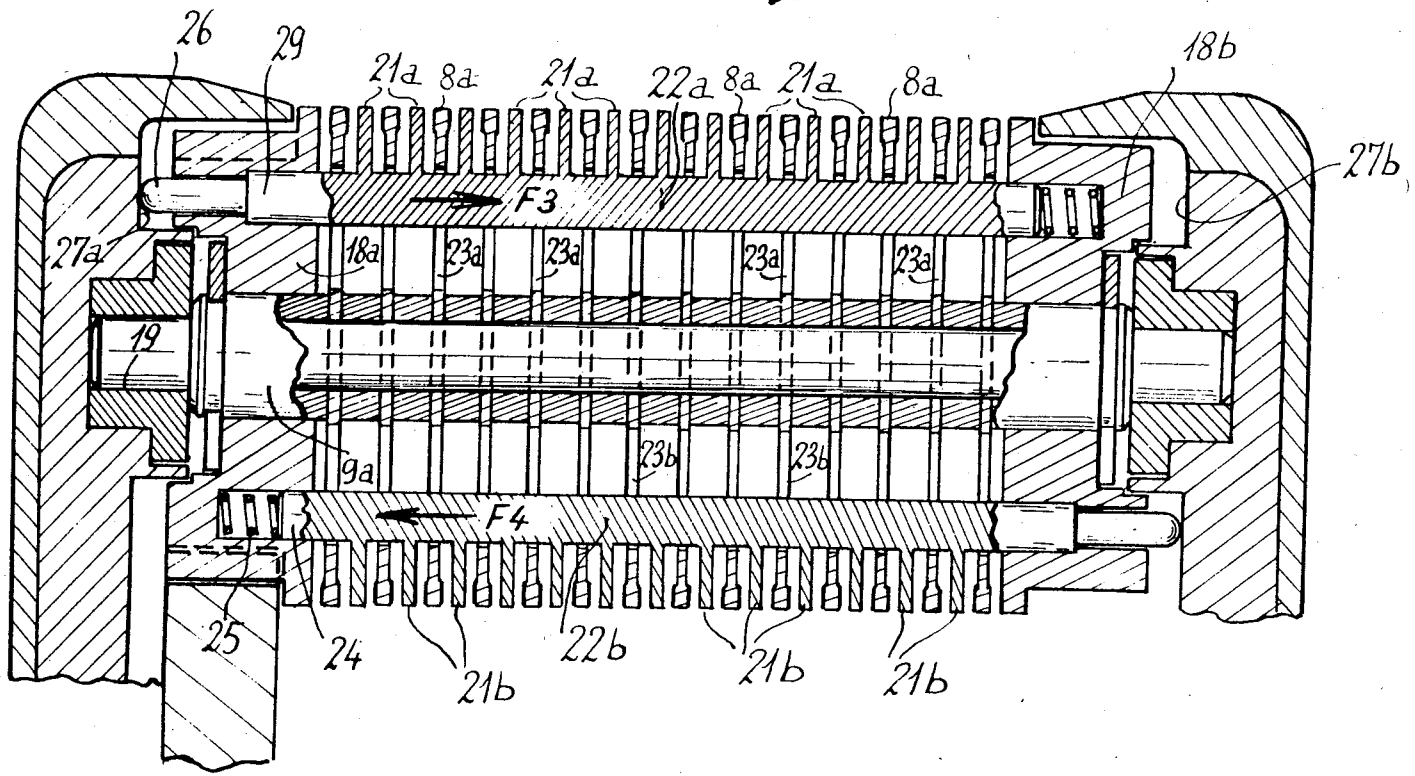
FIGS. 7 and 8 are fragmentary part-sectional views taken along different planes of cross-section.

However, as is clearly shown in FIG. 6, the arrangement of the two combs is reversed and provision is made for a cam 27*a* or 27*b* on each corresponding wall of the casing. Under these conditions, one of the hair-gripping combs, namely the comb 21*a* in the example shown, is caused to move in the direction of the arrow F3 whilst the other comb is caused to move in the reverse direction indicated by the arrow F4. In consequence, hairs which have engaged within the appliance are alternately applied against each face of each rotary disk 8*a*.

In order to prevent the hair-gripping combs from rotating about their own axes, they are provided at least at the ends thereof with a projecting lug 29 of non-circular cross-section (as shown in FIG. 9) which is engaged within a recess having the same cross-section and formed in the corresponding end-plate 18*a* or 18*b*. It is in fact preferable to ensure that the hair-gripping blades of said combs continuously occupy the same relative angular position with respect to the rotary disks 8*a*.

Plucking of hairs which have engaged within the appliance takes place substantially in the same manner as in the preceding embodiment, that is to say by applying the hairs against the rotary disks 8*a* which then exert a pull on the hairs as said disks rotate. However, the hairs are not gripped between two disks but between one of these latter and one of the blades of one of the movable hair-gripping combs. At each revolution, two similar hair-gripping operations take place in the rotating roller unit formed by the disks 8*a*.

The appliance in accordance with the second embodiment has an even higher degree of efficiency than the appliance of the first embodiment but does not considerably increase in cost with respect to the first appliance since each movable hair-gripping comb can be constituted by a single-piece unit which is molded from plastic material.

If necessary, the rotating roller unit of the present invention could comprise only one hair-gripping comb instead of two. Conversely, the roller unit could comprise four combs instead of two or any other number which is compatible with the dimensions of the appliance. Furthermore, the means for controlling the longitudinal displacement of each hair-gripping comb could be constructed differently.

I claim:

1. A depilating appliance for plucking hairs to be removed by means of moving elements driven by an electric motor housed within a casing which can be held in one hand, wherein said elements for plucking hairs comprise a series of disks placed in adjacent relation with a small clearance between them and forming a roller unit rotatably mounted behind a slot, a grid or the like provided in one end of the casing and wherein provision is made for means whereby hairs which have engaged between the disks are periodically gripped and clamped against said disks in such a manner as to ensure that said hairs are thus pulled by the disks and plucked-out as a result of rotational displacement of said disks.

2. An appliance according to claim 1, wherein the means for periodically gripping the hairs to be plucked-out comprise a series of parallel hair-gripping blades engaged between the rotary disks and carried by a support which is mounted so as to be capable of displacement in a direction parallel to the disk shaft, means being provided for periodically displacing said support in such a manner as to apply the hair-gripping blades against the rotary disks in order to imprison the hairs to be plucked.

3. An appliance according to claim 2, wherein the support for the hair-gripping blades consists of a shaft which is parallel to the shaft of the rotary disks and the ends of which are slidably mounted within end-plates carried by the ends of the rotary-disk shaft, said blade shaft being engaged through openings formed in said rotary disks.

4. An appliance according to claim 3, wherein the hair-gripping blades occupy only part of the surface of the rotary disks near their periphery and the openings formed in said disks are displaced with respect to the final position of said blades but are sufficiently large to allow said blades to pass through said openings at the time of assembly of the appliance.

5. An appliance according to claim 4, wherein the means for controlling the displacement of the shaft which carries the hair-gripping blades consist of a cam provided on the corresponding wall of the casing opposite to a projecting end of said shaft.

6. An appliance according to claim 5, wherein provision is made for two separate series of hair-gripping blades which are carried by sliding shafts and are placed in diametrically opposite positions with respect to the rotary-disk shaft, the function of the driving means being to produce a displacement of one sliding shaft in one direction and a displacement of the other sliding shaft in the opposite direction.

7. An appliance according to claim 1, wherein the rotary disks are flexible or resilient and the means for periodically gripping hairs to be plucked-out consist of means for closing-up and applying all the rotary disks against each other in proximity to that portion of the disks which is located behind the slot or grid of the casing, the periodic hair-gripping action being produced by deformation of said disks.

8. An appliance according to claim 7, wherein the means for closing-up and applying the rotary disks against each other are provided by the combination of at least one boss carried by each end disk of the roller unit formed by said disks, and of two cams placed opposite to each end of said roller unit.

9. An appliance according to claim 7, wherein the means for closing-up and applying the rotary disks against each other consist of electromagnetic means which are capable of producing action on the corresponding portion of said disks.

10. An appliance according to claim 1, wherein the inlet slot for engagement of hairs to be plucked is provided at the edge located opposite to the intended direction of displacement of the appliance with a projecting nose which is capable of producing a "raking-in" action in order to cause the hairs to engage within said slot.

* * * * *